US006352057B1

(12) United States Patent
Drecq

(10) Patent No.: US 6,352,057 B1
(45) Date of Patent: Mar. 5, 2002

(54) SUPER CHARGED TWO-STROKE OR FOUR-STROKE INTERNAL COMBUSTION ENGINE

(76) Inventor: Daniel Drecq, 8, rue Octave Allaire, 78610 Saint Leger en Yvelines (FR)

( * ) Notice: Subject to any disclaimer, the term of this patent is extended or adjusted under 35 U.S.C. 154(b) by 0 days.

(21) Appl. No.: 09/477,354

(22) Filed: Jan. 4, 2000

(30) Foreign Application Priority Data

Jan. 7, 1999 (FR) ..... 99 00093
Sep. 7, 1999 (FR) ..... 99 11162

(51) Int. Cl.[7] ..... F02B 33/04; F02B 33/20
(52) U.S. Cl. ..... 123/66; 123/72; 123/197.3
(58) Field of Search ..... 123/66, 70 R, 123/72, 195 AC, 197.3

(56) References Cited

U.S. PATENT DOCUMENTS

| | | | | | |
|---|---|---|---|---|---|
| 2,542,707 | A | * | 2/1951 | Ricardo et al. | 123/72 |
| 2,609,802 | A | * | 9/1952 | Schnurle et al. | 123/72 |
| 2,726,646 | A | * | 12/1955 | Black | 123/72 |
| 4,974,554 | A | * | 12/1990 | Emery | 123/48 B |
| 5,299,537 | A | * | 4/1994 | Thompson | 123/72 |
| 5,660,151 | A | * | 8/1997 | Yoshizawa | 123/63 |

FOREIGN PATENT DOCUMENTS

| | | | |
|---|---|---|---|
| AT | 313458 | 6/1973 | |
| DE | 807566 | 4/1951 | |
| DE | 808297 | 5/1951 | |
| DE | 42 36 899 A1 | 5/1994 | |
| FR | 175413 * | 7/1953 | 123/72 |
| WO | WO 93/18287 | 9/1993 | |

* cited by examiner

*Primary Examiner*—Willis R. Wolfe
*Assistant Examiner*—Hai Huynh
(74) *Attorney, Agent, or Firm*—Connolly Bove Lodge & Hutz LLP

(57) ABSTRACT

Two-stroke or four-stroke internal combustion engine (M1), operating by admitting a carburated mixture or by admitting fresh air with the direct or indirect injection of fuel, the engine having at least one cylinder (1) defining a variable-volume combustion chamber in which an engine piston (4) coupled by a connecting rod (7) to the wrist pin (8) of a crankshaft (9) executes a reciprocating movement, and a compressor associated with each cylinder in order to super-charge the cylinder with carburated mixture or with fresh air, characterized in that said compressor is a compressor with at least one stage, in the compression chamber (14*a*, 14*b*) of which there moves a compressor piston (212) which is coupled to the crankshaft by a link rod (111) articulated to an eccentric (10), said eccentric being mounted on the shaft of said crankshaft.

18 Claims, 10 Drawing Sheets

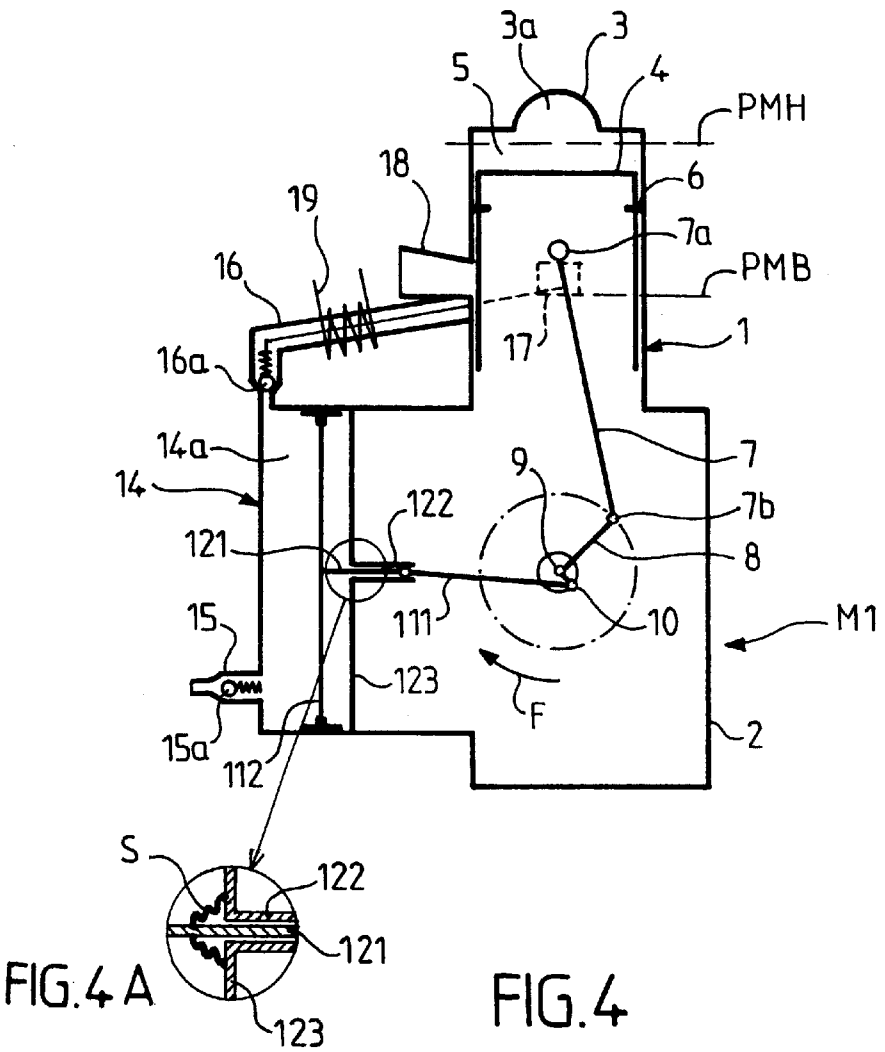
FIG.4
FIG.4A
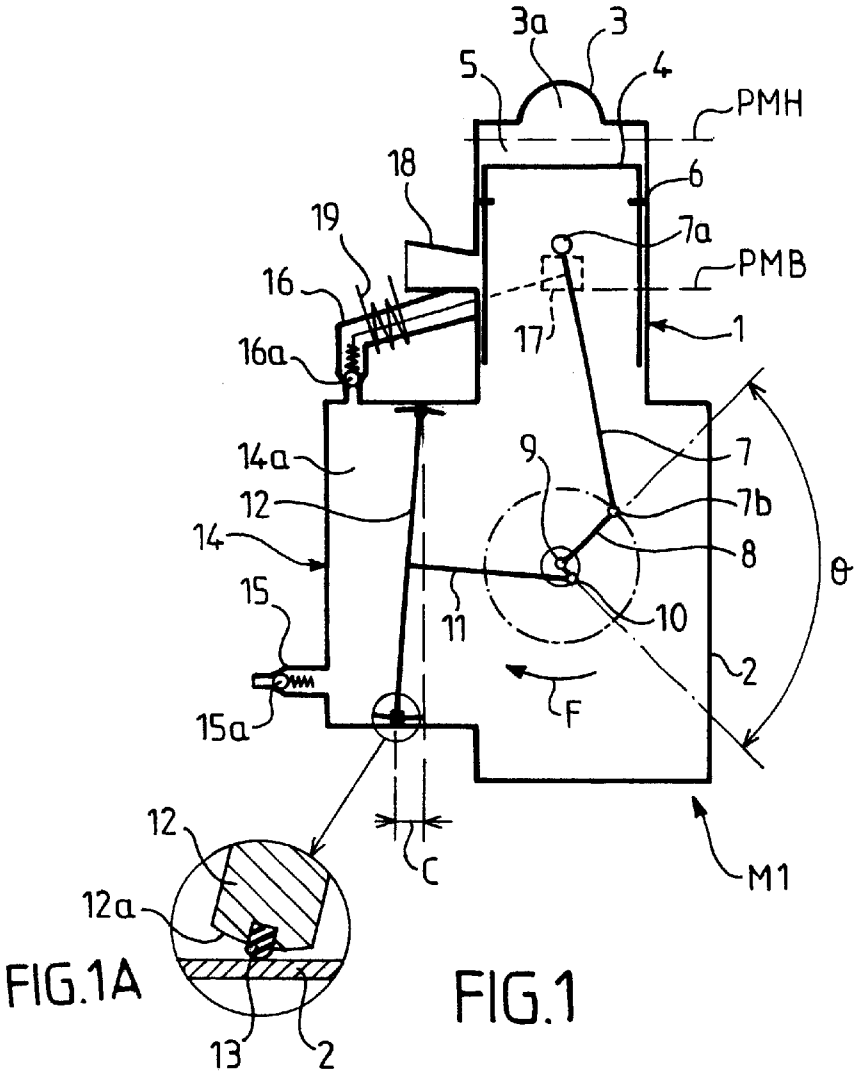
FIG.1
FIG.1A

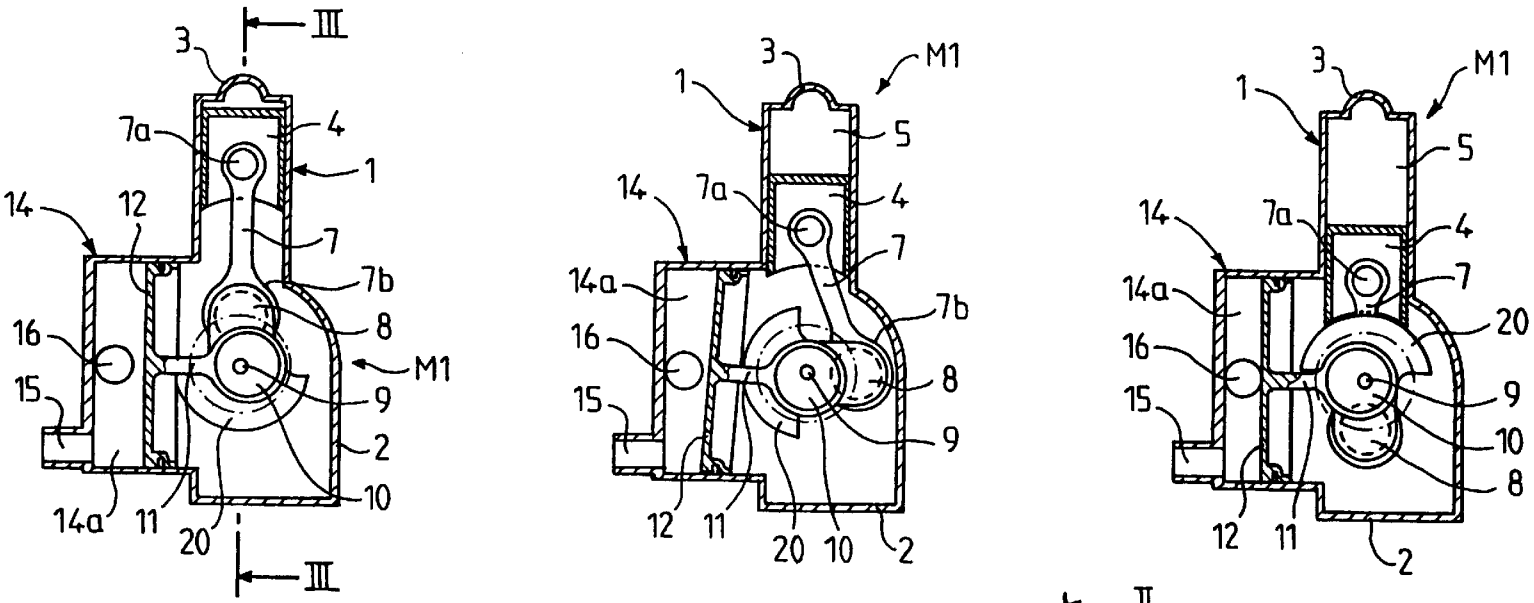
FIG. 2A
FIG. 2B
FIG. 2C
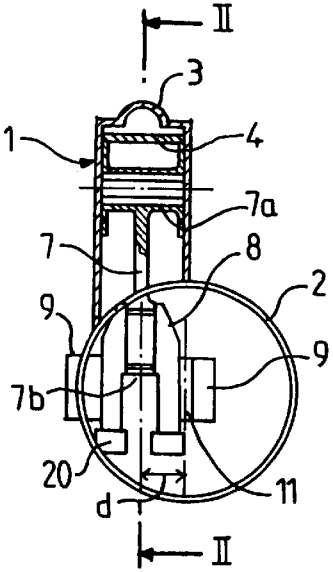
FIG. 3
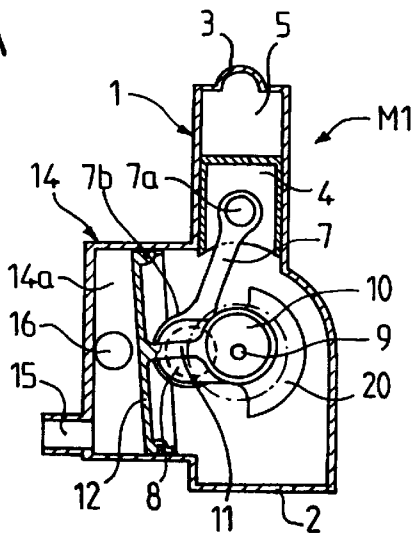
FIG. 2D

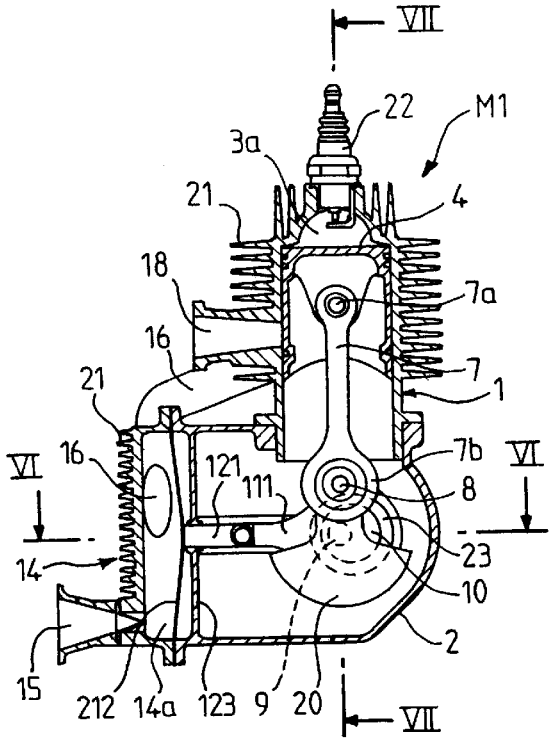
FIG.5A
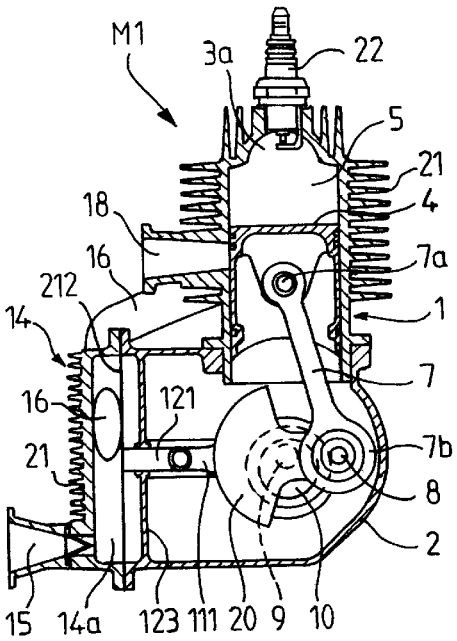
FIG.5B
FIG.6E
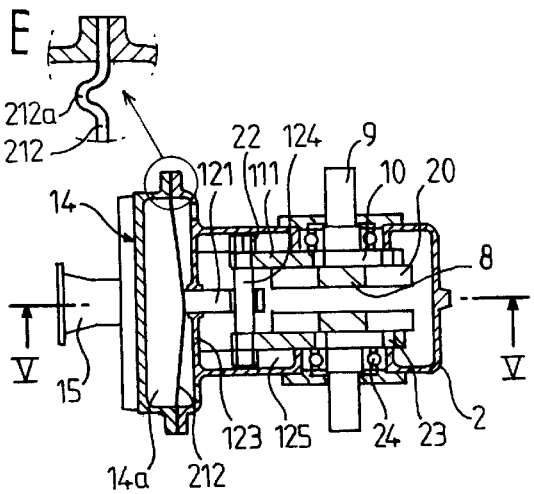
FIG.6A
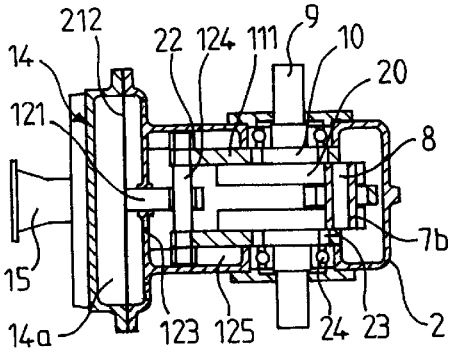
FIG.6B

F1
F2
F3
F4
F
M4
1
2
4
5
7
7a
8
9
10
11
12
14
14a
15
15a
16
16a
118
118a
217

SUPER CHARGED TWO-STROKE OR FOUR-STROKE INTERNAL COMBUSTION ENGINE

The present invention relates to a supercharged two-stroke or four-stroke internal combustion engine having one or more cylinders, and operating by admitting a carburated mixture or by admitting fresh air with the direct or indirect injection of fuel. The invention is just as applicable to petrol engines equipped with spark plugs as it is to diesel engines which use compression ignition.

Although the invention is described hereinafter with more particular reference to a single-cylinder engine in the case of a two-stroke engine, which is well suited to all applications of small industrial engines intended for motorized cultivation, garden tools, lawn mowers, cutters, scrub clearers or the like, the invention is not in any way restricted thereto and is also applicable to two-stroke or four-stroke multi-cylinder in-line or V engines.

A two-stroke single-cylinder engine which operates with natural aspiration into the cylinder of a carburated mixture which passes through the crankcase is already known. This engine has a pipe for admitting the air/fuel mixture and a pipe for exhausting the burnt gases, both of which pipes open in the form of ports toward the bottom of the cylinder, near bottom dead center (PMB). The carburated mixture from the carburetor is drawn into the crankcase through a valve, during the upstroke of the piston which causes a depression in the crankcase, and is then delivered to the cylinder, during the downstroke of the piston, causing a raised pressure in the crankcase. During the downstroke of the piston, the mixture inlet ports are open at practically the same time as the exhaust ports, which means that about 20% of the mixture is discharged directly to the exhaust, leading to a high fuel consumption and a great deal of atmospheric pollution. The main advantage of this engine is its low cost, but new antipollution standards will ultimately spell the end for this type of engine.

Another known engine is of the loop scavenging type, which operates with a positive-displacement compressor, for example of the Roots type, making it easier to introduce the carburated mixture into the cylinder and to generate low-pressure supercharging. This engine also has a mixture inlet pipe and an exhaust pipe, the pipes both opening via ports toward the bottom of the cylinder. In this engine, the carburated mixture is admitted into the cylinder from the compressor, with an orientation such that the mixture experiences a loop-like upward rotating movement after the manner of a "loop-the-loop" in the cylinder, while the burnt gases from the previous cycle are discharged to the exhaust ports. The particular arrangement of the inlet and exhaust ports makes it possible for part of the admitted mixture not to be exhausted directly, and this reduces both fuel consumption and environmental pollution.

Yet another known engine is of the uniflow type, which also operates using a positive-displacement compressor. This engine has an inlet pipe connected at its upstream end to the compressor and at its downstream end to an inlet ring which opens via a number of ports toward the bottom of the cylinder, with an orientation such that the mixture is introduced with a great deal of rotational movement. The burnt gases are discharged at the top of the cylinder through one or more exhaust valves. This type of engine allows control over the filling of the cylinder and the possible recirculation of burnt gases, so as to obtain combustion which causes less pollution. Furthermore, when this type of engine is operating on the diesel cycle, introducing the air near the bottom of the cylinder makes it possible to obtain a great deal of air rotation, which is needed for obtaining good efficiency. This engine makes it possible to consume even less fuel than the loop-scavenging engine, and also makes it possible to reduce polluting emissions.

However, these last two types of engine cost far more than engines with transfer via the crankcase, because they contain more parts, particularly the compressor, and furthermore, in the case of the uniflow engine, valve control means. Furthermore, compressors of the Roots type are of low efficiency; for example, a two-stroke single-cylinder engine with a one-liter cylinder capacity and a power of 55 kW will consume 17 kW for driving the compressor. What is more, a Roots compressor does not operate beyond a pressure higher than 1.2 bar.

Finally, engines with exhaust and inlet valves are known and these are able to obtain the lowest consumptions and the lowest emissions, but this type of engine is also the most expensive because both the exhaust valves and the inlet valves have to be controlled. The efficiency of this engine is better because the control of the opening and closing of the valves using parts external to the cylinder means that the entire piston stroke can be used whereas with the previous engines in which admission was via ports, part of the compression stroke and of the expansion stroke was lost.

The object of the invention is to provide a supercharged two-stroke or four-stroke internal combustion engine, for example of the loop scavenging, uniflow or valve type, or of the four-stroke valves type, which allows the efficiency to be improved and the emissions to be reduced.

To this end, the subject of the invention is a two-stroke or four-stroke internal combustion engine, operating by admitting a carburated mixture or by admitting fresh air with the direct or indirect injection of fuel, the engine having at least one cylinder defining a variable-volume combustion chamber in which an engine piston coupled by a connecting rod to the wrist pin of a crankshaft executes a reciprocating movement, and a compressor associated with each cylinder in order to supercharge the cylinder with carburated mixture or with fresh air, characterized in that said compressor is a compressor with at least one stage, in the compression chamber of which there moves a compressor piston which is coupled to the crankshaft by a link rod articulated to an eccentric, said eccentric being mounted on the shaft of said crankshaft.

As a preference, the angle of the dihedron, the solid angle of intersection of which is formed by the axis of the crankshaft and the two half-planes of which extend one toward the eccentric and the other toward the wrist pin, is of the order of 90° so as to obtain a phase shift between the top dead center (PMH) positions of the engine piston and of the compressor piston which are associated with the same cylinder, which phase shift ensures that the pressure in the compression chamber is at its maximum before the carburated mixture or the fresh air is admitted into the combustion chamber.

In this case, when the stage of the compression chamber which communicates directly with the cylinder is located between the compressor piston and the crankshaft, the wrist pin has a phase shift in advance of the eccentric in the direction of rotation of the crankshaft and, conversely, when the aforementioned stage is on the opposite side of the compressor piston to the crankshaft, the eccentric has a phase shift in advance of the wrist pin in the direction of rotation of the crankshaft.

Advantageously, the cylinder capacity of the compressor is of the order of magnitude of that of the cylinder, but with a compressor piston which has a diameter markedly greater than the diameter of the engine piston, so that the compressor piston has a short compression stroke in the compression chamber.

In a particular embodiment, the compressor piston is rigidly attached at its center to the link rod for connection with the eccentric so that the compressor piston moves in the compression chamber by rocking back and forth about lower and upper parts of the compression chamber, the axis of the compressor being offset, in the direction of the axis of the crankshaft, with respect to the axis of the cylinder. In this case, the compressor piston can have, at its periphery, a spherical edging fitted with a spherical sealing ring which is preferably unable to rotate with respect to the compressor piston, in a position such that the gap in the ring is not placed at the bottom of the compressor, so as to limit the oil consumption and therefore the environmental pollution.

In another embodiment, the compressor piston is secured at its center to a rod articulated to the link rod for connection to the eccentric, said rod being guided in translation in a direction which intersects the axis of the cylinder. In a first alternative form, the compressor piston is a deformable diaphragm connected at its periphery to the side wall of the compression chamber, said diaphragm preferably having an undulation at its periphery, to make it easier to deform. In a second alternative form, the compressor piston is a rigid cylinder which can move in axial translation and is fitted at its periphery with at least one sealing ring.

This second embodiment is advantageous in that it carries no risk of oil passing between the crankcase and the compression chamber of the compressor, because it is possible to arrange a seal or a sealing boot on the compressor piston rod.

In one particular embodiment, the compression chamber has two stages located one on each side of the compressor piston, a first stage being supplied with carburated mixture or with fresh air by a first nonreturn valve or a valve, and connected by a delivery duct fitted with a second nonreturn valve or a valve to the second stage which communicates with the cylinder via an inlet duct possibly fitted with a third nonreturn valve or a valve. The use of a two-stage compressor makes it possible to obtain a higher boost pressure in the cylinder. However, in this case, the volumetric ratio of the cylinder may be reduced so as not to reach a maximum combustion pressure which is incompatible with the mechanical strength of the cylinder. The engine equipped with this two-stage compressor will work in a similar way to the known hyperbaric-type supercharging system.

The two-stroke engine of the invention may also be fitted with a device for recovering the energy in the exhaust puffs and for partially recirculating the exhaust gases by providing an additional volume communicating with the cylinder through closure and opening means, the movements of which are controlled either in synchronism or with a phase shift with respect to those of the engine piston in the cylinder so that during the expansion phase, the burnt gases compress the air in the additional volume and at least partially enter it, so that this air and burnt gases mixture is trapped under pressure therein, and then so that this mixture is admitted into the cylinder during the compression phase.

Advantageously, after the air and burnt gases mixture previously trapped in the additional volume has been admitted into the cylinder, said additional volume is once again filled with fresh air from the compressor.

According to another feature, the aforementioned closure and opening means comprise two rotary shutters, for example multi-way rotary spools, connected to each other by the additional volume, one of the shutters being associated with the compressor, and the other shutter being associated with the exhaust from the cylinder.

As a preference, the two rotary shutters are arranged in such a way that the following operations take place: in a first phase, when the engine piston is near its PMH, a flow of air from the compressor passes through the lower shutter associated with the compressor, sweeps through the additional volume, passes through the upper shutter associated with the exhaust and is exhausted to the outside via an exhaust manifold; in a second phase, from about halfway through the expansion stroke of the engine piston, on the one hand, the upper shutter places the cylinder in communication with the additional volume so as to fill it with a pressurized mixture of air and burnt gases and, on the other hand, the cylinder communicates with the exhaust; in a third phase, the upper shutter traps the air and burnt gases mixture in the additional volume; in a fourth phase, air from the compressor is admitted into the cylinder and, in a fifth phase, at the start of the engine piston compression stroke, the trapped and pressurized mixture is admitted into the cylinder.

In a first alternative form, the upper shutter is associated with at least one exhaust valve located at the top of the cylinder and the lower shutter is connected to the cylinder by a pipe arranged toward the bottom of the cylinder so that the additional volume is pressurized via its upper end by the burnt gases from the exhaust valve through the upper shutter and is emptied into the cylinder via its lower end through the lower shutter.

In a second alternative form, the upper shutter is connected to the cylinder by a pipe arranged toward the bottom of the cylinder and the lower shutter is fitted on the delivery pipe between the two stages of the compressor so that the additional volume is pressurized by means of the burnt gases from the cylinder through the upper shutter and is emptied into the cylinder through the pipe connected to the upper shutter.

Advantageously, in the case of two-stroke or four-stroke engines, the inlet pipe to the cylinder and/or the delivery pipe from the two-stage compressor is cooled by any appropriate means.

The two-stroke engine may be of the loop scavenging type, in which the carburated mixture or the fresh air is admitted from the compressor through an inlet duct opening via ports into the lower part of the cylinder with an orientation such that the mixture or the air is introduced with a looping upward rotating movement, while the burnt gases from the previous cycle are discharged through exhaust ports also arranged toward the bottom of the cylinder.

The two-stroke engine may alternatively be of the uniflow type, in which the carburated mixture or the air is admitted toward the bottom of the cylinder through inlet ports distributed at the base of the cylinder and supplied by a ring, itself connected to the compressor, while the burnt gases from the previous cycle are discharged through one or more exhaust valves located at the top of the cylinder.

Finally, the two-stroke or four-stroke engine may be of the type with exhaust and inlet valves, in which the valves are located at the top of the cylinder and the inlet valve or valves are supplied by the compressor.

The invention is also applicable to an engine of the type with several in-line cylinders, in which the compressors associated with each cylinder are arranged alternately on each face of the crankcase.

To allow better understanding of the subject matter of the invention, several embodiments thereof depicted in the appended drawing will now be described by way of purely illustrative and nonlimiting examples.

In this drawing:

FIG. 1 is a diagrammatic view in vertical section of a first embodiment of the engine of the invention, of the two-stroke loop-scavenging type with a single-stage compressor and a rocking compressor piston, with a partial enlargement of the latter in FIG. 1A;

FIGS. 2A to 2D are part views similar to FIG. 1 and in vertical section on the line II of FIG. 3, respectively depicting the engine piston at its PMH, during expansion, at its PMB and during compression, in the case of a two-stroke engine;

FIG. 3 is a view in section on the line III of FIG. 2A;

FIG. 4 is a view similar to FIG. 1, but according to an alternative form in which the compressor piston is of the linear displacement type, with a partial enlargement of the latter in FIG. 4A;

FIGS. 5A to 5D are views similar to FIGS. 2A to 2D and in vertical section on the line V of FIG. 6A, but depicting another alternative form in which the compressor piston is a deformable diaphragm and the cylinder is equipped with a spark plug;

FIGS. 6A to 6D are views in section on the line VI of FIGS. 5A to 5D respectively, with a partial enlargement of said diaphragm in FIG. 6E;

For reasons of clarity, elements which are identical or similar will carry the same reference numerals in all the figures.

FIGS. 1 to 9 depict various alternative forms of the invention applied to a two-stroke single-cylinder internal combustion engine M1 with loop scavenging.

Figure 5C:
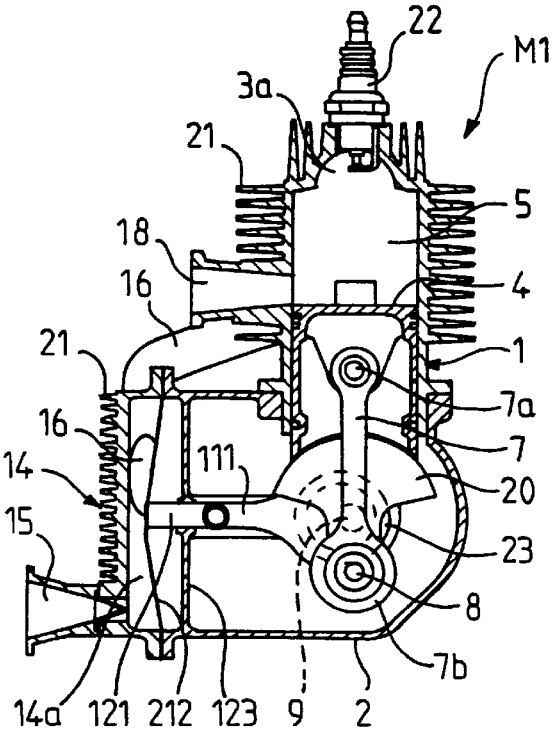

In the first alternative form depicted in FIGS. 1 to 3, the engine M1 has a cylinder 1 defined between the crankcase 2 and the cylinder head 3 of the engine. The cylinder head 3 has a recess 3*a* toward the top of the cylinder 1 to define a combustion chamber, because the proposed depiction is that of a petrol engine. The invention may just as easily be applied to a direct-injection or indirect-injection diesel engine.

An engine piston 4 which defines a combustion chamber 5 inside the cylinder 1 between the cylinder head 3 and the piston 4 executes a reciprocating movement inside the cylinder 1. The engine piston 4 is fitted at its periphery with sealing rings 6 depicted in FIG. 1. A connecting rod 7 is articulated by its small end 7*a* to the piston 4 and by its big end 7*b* to the wrist pin 8 of a crankshaft 9.

An eccentric 10 is mounted on the shaft of the crankshaft 9 and articulated to a link rod 11 which is rigidly attached to the center of a disk-shaped compressor piston 12. The compressor piston 12 has, at its periphery, a spherical edging 12*a* fitted with a sealing ring 13 the edging of which is also spherical, which is prevented from rotating with respect to the compressor piston, in a position such that the gap in the ring 13 is not placed at the bottom of the crankcase 2 as visible in FIG. 1A. The compressor piston 12 rocks back and forth inside the compression chamber 14*a* of a single-stage compressor 14 attached to the crankcase 2. The compression chamber 14*a* of the compressor 14 is supplied with carburated mixture or with fresh air by an intake pipe 15 or is fitted with a nonreturn intake valve 15*a*. The carburated mixture or the fresh air under pressure is delivered from the compressor 14 to an inlet pipe 16 fitted with a nonreturn delivery valve 16*a*. The inlet pipe 16 opens toward the bottom of the cylinder 1 via a number of ports 17 orientated such that the pressurized mixture or air is introduced with an upward looping rotational movement into the cylinder in the manner of a loop-the-loop. The cylinder 1 is further equipped with one or more exhaust ducts 18 which open toward the bottom of the cylinder, at roughly the same level as the intake ports 17.

As visible in FIG. 1, the eccentric 10 is offset by an angle θ of the order of 90° with respect to the crank wrist 8, in the direction of rotation of the crankshaft, as indicated by the arrow F, so that the PMH of the engine piston 4 is phase-shifted by 90° from the PMH of the compressor piston 12. Referring to FIG. 3, it may be seen that the axis of the link rod 11 of the compressor 14 is offset by a distance d from the axis of the connecting rod 7 of the engine piston 4.

The cylinder capacity of the cylinder 1 is roughly of the same order of magnitude as the cylinder capacity of the compressor 14, but the compressor piston 12 has a diameter markedly greater than that of the engine piston 4, so that the compression stroke c of the compressor piston 12 is relatively short.

Finally, the inlet pipe 16 may be fitted with a heat exchanger 19, carrying a coolant, for example water, or alternatively fresh air may be blown through in the case of an air-cooled engine, to cool the air leaving the compressor 14, thus making it possible to increase the mass of air admitted into the cylinder 1, especially since compressing the air in the compressor 14 gives off a large amount of heat. However, cooling the inlet pipe 16 is optional.

Referring now to FIGS. 2 and 3 it can be seen that the wrist pin 8 of the crankshaft 9 is fitted, at the opposite end to the big end of the connecting rod 7*b*, with a flyweight 20 which acts as a counterweight.

The positions of the PMH and PMB of the engine piston 4 have been marked in FIG. 1 using broken line.

The path of the eccentric 10 and the path of the wrist pin 8 have also been marked in FIG. 1, in chain line.

The way in which this engine works will now be described with reference to FIGS. 2A to 2D.

In FIG. 2A, the engine piston is at the end of compression, at its PMH, while the compressor piston 12 is at its PMB, that is to say in its position furthest to the right in FIG. 2A. During expansion, under the action of the combustion of the gases in the combustion chamber 5, the engine piston effects a downstroke, as illustrated in FIG. 2B, once the crankshaft 9 has rotated through about 90°, and this simultaneously causes the compressor piston 12 to rock about its upper portion, thus performing a first compression in the compression chamber 14*a*. At the end of expansion, the engine piston 4 reaches its PMB, simultaneously uncovering the exhaust duct 18 and the inlet ports 17, after an additional rotation of the crankshaft 9 through 90°. At the same time, the compressor piston 12 rocks about its lower portion to reach its position of maximum compression furthest to the left in the compression chamber 14*a*, which causes the pressurized air or carburated mixture to be admitted into the combustion chamber 5, thus driving the burnt gases toward the exhaust and filling the cylinder. FIG. 2D depicts the engine piston during its compression phase, after an additional rotation of the crankshaft through 90°, and this simultaneously closes the exhaust and the inlet and causes the compressor piston 12 to rock about its upper portion, and thus allow a first expansion of the compression chamber 14*a*, the fresh air or the carburated mixture being drawn in through the intake pipe 15 because of the depression thus generated in the chamber 14*a*. Finally, when the engine piston 14 reaches its PMH illustrated in FIG. 2A, after an additional rotation of the crankshaft 9 through 90°, the compressor piston 12 rocks about its lower portion to return to its position furthest to the right, the fresh air or the carburated mixture continuing to be thus drawn into the compression chamber 14*a*. The running cycle which has just been described is thus repeated over and over again.

As visible in FIGS. 2A to 2D, the eccentric 10 is formed of a disk mounted eccentrically on the shaft of the crankshaft 9.

However, because of the back and forth rocking of the compressor piston 12, there is the risk that the oil contained in the crankcase might pass into the compression chamber 14*a*, causing oil to be consumed and causing pollution of the environment because the oil is thus discharged to the outside.

This drawback is prevented in the alternative form illustrated in FIGS. 4 to 7, in which the rocking compressor piston 12 is replaced by a compressor piston 112 illustrated in FIG. 4 which reciprocates back and forth in linear translation in the compression chamber 14*a*.

At its periphery this compressor piston 112 also has a sealing ring and at its center has a rod 121 rigidly attached to the compressor piston 112 and articulated at its free end to the link rod 11 for connecting with the eccentric 10. The rod 121 is guided in translation by a guide sleeve 122 which is connected to the crankcase 2 via a vertical partition 123. The sleeve 122 may be fitted internally with a sealing ring through which the rod 121 passes, or alternatively a sealing boot S may be connected between the rod 121 and said vertical partition 123, eliminating any risk of oil passing between the crankcase and the compressor as visible in FIG. 4A.

Figure 5D:
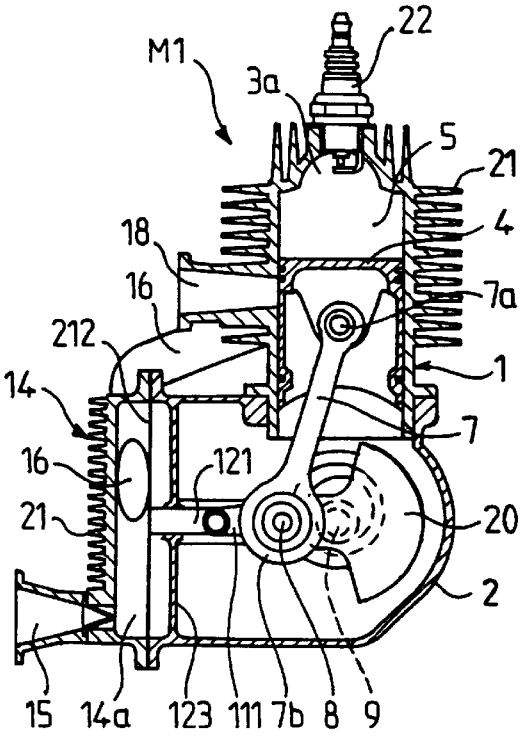
Figure 6C:
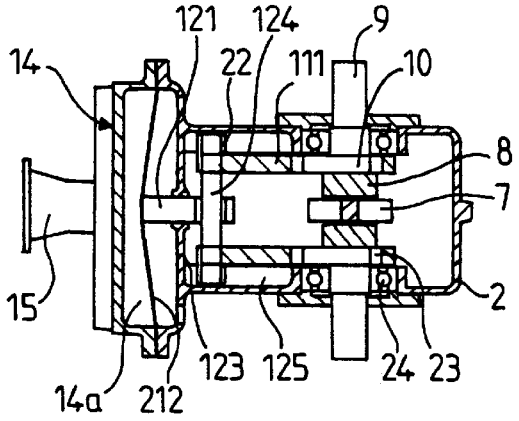
Figure 6D:
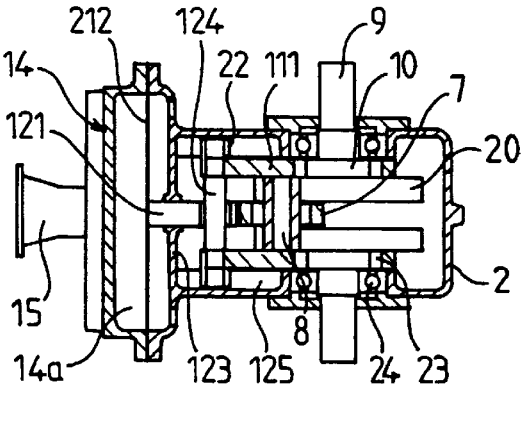
Figure 7:
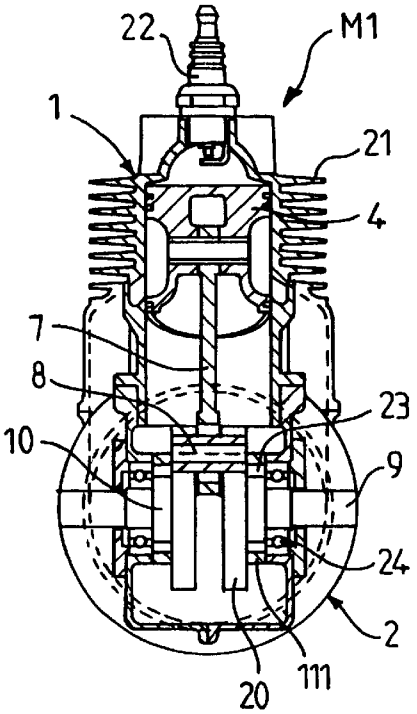
FIG. 7 is a view in section on the line VII of FIG. 5A.

In FIGS. 5 to 7 it can be seen that the cylinder 1 and the compressor 14 are fitted with cooling fins 21.

Arranged at the top of the cylinder 1 is a spark plug 22.

The engine M1 here consists of a first unit which forms the cylinder 1, a second unit which forms the crankcase 2 and a third unit which forms the compressor 14. Thus the compressor piston 112 in the form of a rigid disk may be replaced by a deformable diaphragm 212, the periphery of which is fixed between the aforementioned second and third units. To make the diaphragm 212 easier to deform, an undulation 212*a* may be provided near its periphery, as visible in FIG. 6E.

As best visible in FIGS. 6A to 6D, the rod 121 connects the center of the deformable diaphragm 212 to an articulated crossmember 124, the free ends of which slide in a groove 125 made in the crankcase 2 and are each connected to two arms 111 which extend on both sides of the axis of the compressor 14. The link rod for connection to the eccentric is thus formed by the assembly comprising the crossmember 124 and the two arms 111. The two arms 111 of the link rod are each mounted on a disk 10 which is mounted respectively and eccentrically on the shaft 9 of the crankshaft between the side wall of the crankcase 2 and a web of the wrist pin 8. Needle bearings 22 to 24 are provided at the free ends of the crossmember 124 between each link rod arm 111 and the eccentric disk 10, and at the shaft of the crankshaft 9, respectively. However, if the rotation is slow enough, these bearings could be replaced by ball bearings or by journal bearings.

As visible in FIG. 7, in this case, the axis of the compressor piston is centered on the axis of the engine piston, unlike the rocking compressor piston alternative form of FIGS. 1 to 3.

The operating cycle of this engine, the compressor piston of which is mounted using a crosshead link, is essentially the same as that of the rocking-piston engine. As the crankshaft 9 rotates, the crossmember 124 moves in a straight translation motion in the grooves 125, which causes the rod 121 to move and this causes the diaphragm 212 to deform. In FIG. 5A, the engine piston 4 is at its PMH, and the diaphragm is deformed in bending to the right toward the crankshaft. In FIG. 5B, the engine piston is halfway through its stroke in the expansion phase, and the diaphragm 212 is in an essentially flat vertical position. In FIG. 5C, the engine piston 4 is at its PMB, and the diaphragm 212 is deformed in bending to the left, away from the crankshaft. Finally, in FIG. 5, the engine piston 4 is halfway through its compression upstroke and the diaphragm 212 is once again in a flat position, at rest.

By way of example, the engine depicted in FIGS. 5 to 7, has one cylinder 1 with a diameter of about 42 mm and a working stroke of 38 mm for the engine piston 4, and a compressor 14 with a diameter of 80 mm and a working stroke of about 8.5 mm in the case of the compressor piston 212.

Figure 8:
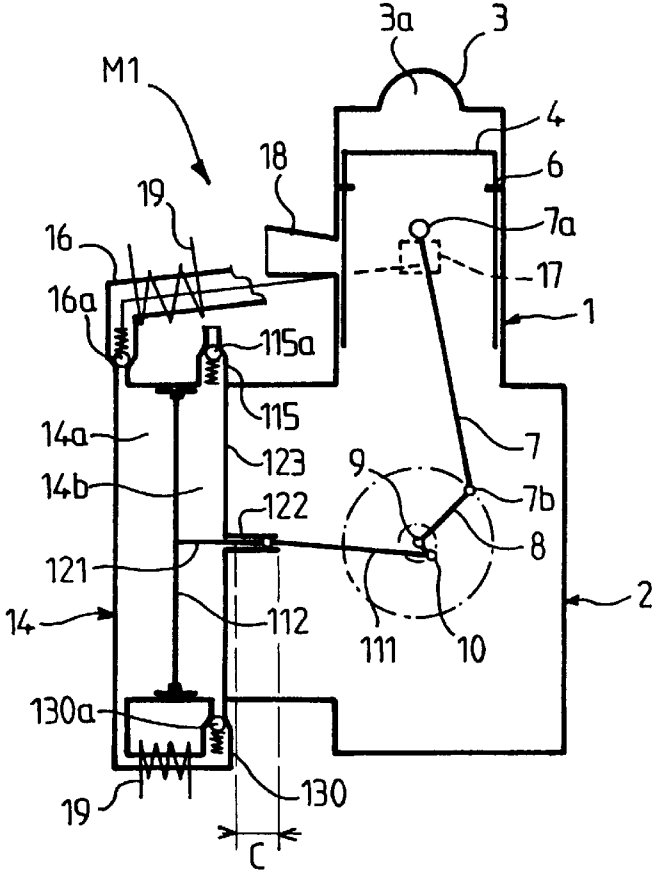
FIG. 8 is a view similar to FIG. 4 but depicting a two-stroke engine with a two-stage compressor.

The alternative form illustrated in FIG. 8 differs from the alternative form depicted in FIG. 4 essentially in the fact that the compressor 14 comprises a compression chamber with two stages 14*a* and 14*b*. The first stage 14*b* is formed between the partition 123 and the compressor piston 112, while the second stage 14*a* is formed on the other side of the compressor piston 112. The first stage 14*b* at the top has an intake duct 115 fitted with a nonreturn valve 115*a*. This first stage 14*b* has the piston rod 121 of the compressor 112 passing through it. Toward the bottom of the first stage 14*b* there is an intermediate delivery pipe 130 which communicates toward the bottom with the second stage 14*a* of the compressor 14. This intermediate delivery pipe 130 is fitted with a nonreturn valve 130*a* and with a cooling system 19. The second stage 14*a* of the compressor 14 communicates toward the top with the inlet duct 16, in a similar way to the single-stage compressor described in FIGS. 1 to 7.

The various valves 115*a*, 130*a* and 16*a* of the compressor 14 and the valves 118*a* and 217 of the engine may advantageously be replaced by mechanically or electronically or hydro-electronically controlled valves which can be managed by a digital computer, so as to control all the engine parameters to order, namely the compression ratio in the compressor and/or in the engine cylinder, and the expansion ratios.

Although FIG. 8 depicts a compressor piston 112 in the form of a rigid flat disk, it could just as well be replaced by a deformable diaphragm similar to the one depicted in FIGS. 5 and 6.

During the compression phase of the engine piston 4, the compressor piston 112 moves to the right, to compress the first stage 14*b* of the compression chamber, which causes air to be delivered, via the pipe 130, to the second stage 14*a*. During the expansion downstroke of the engine piston 4, the compressor piston 112 moves to the left, which causes the air contained in the second stage 14*a* to be compressed further, it not being possible for the air to retreat backward through the pipe 130 because of the nonreturn valve 130*a*, and this air therefore escapes to the inlet pipe 16 at a pressure higher than the pressure which would be obtained with a single-stage compressor. At the same time, a depression is caused in the first stage 14*b*, and this causes air to be drawn in from the intake duct 115.

In FIG. 8, the stroke of the compressor piston 112 is depicted c.

Figure 9:
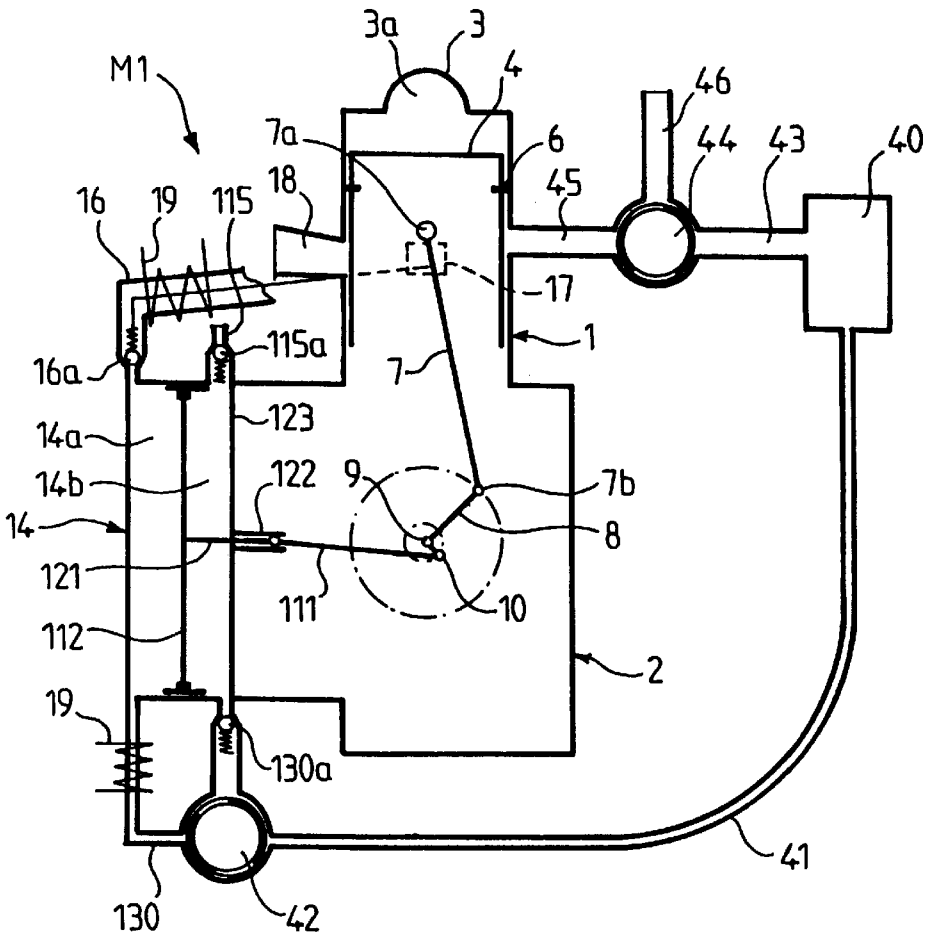
FIG. 9 is a view similar to FIG. 8 but depicting the two-stroke engine further equipped with a system for partially recirculating the exhaust gases.

In FIG. 9, the engine of FIG. 8 is fitted with a device for recovering energy from the exhaust puffs and for partially recirculating the exhaust gases, the principle of which is described in detail in French patent application No. 98-07835 of Jun. 22, 1998, belonging to the current applicant.

An additional volume 40, which may have any appropriate shape, communicates toward the bottom with a pipe 41 which opens to a rotary shutter 42, for example a three-way rotary spool which is fitted in the aforementioned delivery pipe 130 downstream of the valve 130*a*. The additional volume 40 also communicates, toward the top, with a pipe 43 which opens to a second, upper, rotary shutter 44, for example a three-way rotary spool, the latter communicating, on the one hand, via a pipe 45 toward the bottom of the cylinder 1, and, on the other hand, via a pipe 46, with an exhaust manifold (not depicted) connected to the aforementioned exhaust duct 18.

The way in which the engine illustrated in FIG. 9 works will now be described.

When the engine piston 4 comes close to its PMH, during the compression phase, the lower spool 42 causes the first stage 14*b* of the compressor 14 to communicate with the pipe 41, while at the same time shutting the passage to the second stage 14*a*, while the upper spool 44 causes the pipe 43 to communicate with the exhaust pipe 46, while at the same time shutting the passage to the pipe 45 which opens toward the bottom of the cylinder 1. As a result, the air compressed by the compressor piston 112 in the first stage 14*b* is discharged to the exhaust, sweeping the additional volume 40, the remainder of the air and burnt gases mixture in this volume 40 thus being discharged to the outside and replaced with fresh air.

Next, at the start of the expansion phase of the engine piston 4, this phase being depicted in FIG. 9, the spools 42 and 44 shut off any communication, it being possible for the rotation of the spools to be slaved to the rotation of the crankshaft 9, or alternatively controlled by a central electronic management unit.

When the engine piston 4 has practically reached the end of its expansion stroke, the engine piston 4 uncovers the opening of the pipe 45 and the combustion gases under pressure in the cylinder 1 then escape through this pipe 45 and pass through the shutter 44 as far as an additional volume 40, the upper shutter 44 being in a position of shutting off the exhaust pipe 46. At the same time, the shutter 42 closes the passage of the pipe 41, so that the burnt gases compress the air in the additional volume 40 and partially penetrate it.

At the same time as, or shortly after the opening of the pipe 45, the engine piston 40 [sic] also uncovers the exhaust duct 18, to discharge the remainder of the burnt gases, which are driven out by the pressurized fresh air introduced through the inlet ports 17 from the second stage 14*a* of the compressor, under the compression action exerted by the compressor piston 112 moving to the left. When the engine piston 4 reaches its PMB, the upper spool 44 shuts off any communication, and the lower spool 42 opens the passage between the first and second stage of the compressor, while keeping the passage to the pipe 41 closed, so that the pressurized air and burnt gases mixture which was in the additional volume 40, is thus trapped therein. At PMB, scavenging in the cylinder 1 stops and the cylinder begins to fill with fresh air at high pressure delivered by the compressor 14.

When the compression phase in the cylinder begins, the compressor piston 112 delivers the compressed air in the first stage 14*b* to the second stage 14*a* through the lower spool 42 which keeps the communication of the pipe 130 open while at the same time keeping the passage to the pipe 41 closed. At the same time, the upper spool 44 opens the passage between the additional volume 40 and the cylinder 1, keeping the passage to the exhaust pipe 46 closed, so that the air and burnt gases mixture trapped in the volume 40 can escape through the pipes 43 and 45 into the cylinder 1, which simultaneously supercharges the cylinder 1 and allows energy to be recovered from the exhaust puffs.

When the engine piston 4 has covered more than about half of its upstroke, the exhaust duct 18 and the pipe 45 are shut off by the engine piston 4 and the spools 44 and 42 gradually move toward the position which places the first stage 14*b* of the compressor in communication with the exhaust 46.

It will be noted that in this case the two-stage compressor 14 has a lower efficiency than was the case in FIG. 8, because some of the compression stroke of the first stage 14*b* of the compressor 14 is used to sweep the additional volume 40.

The application of the invention to a two-stroke single-cylinder engine of the uniflow type M2 will now be described with reference to FIGS. 10 to 13.

Figure 11:
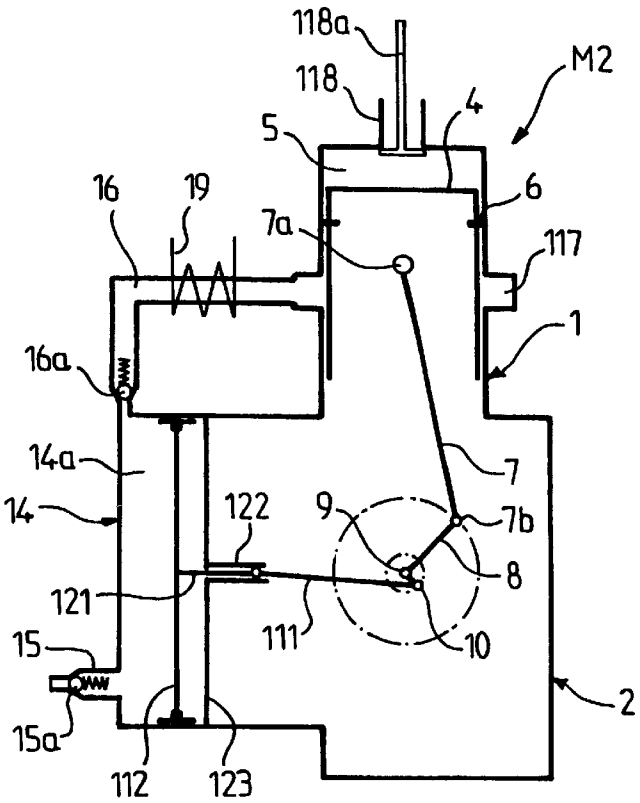
FIGS. 10 and 11 are views respectively similar to FIGS. 1 and 4 but depicting a second embodiment of the two-stroke engine of the invention of the uniflow type.
Figure 10:
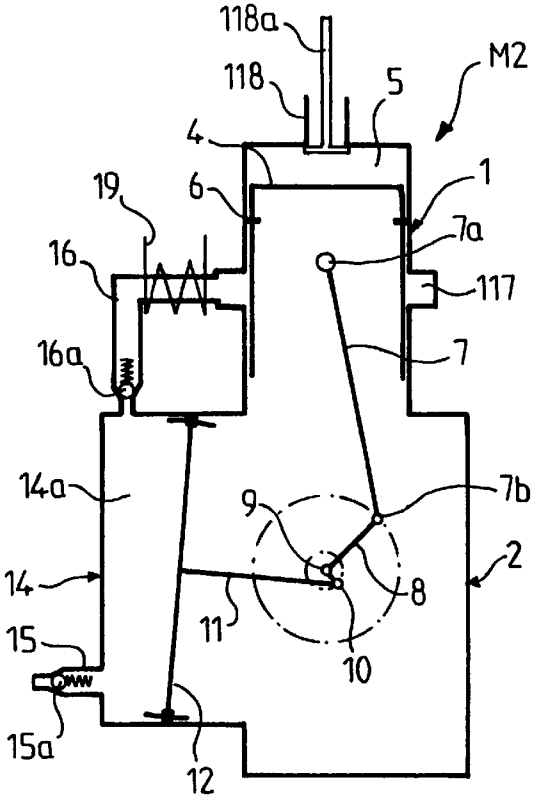
Figure 12:
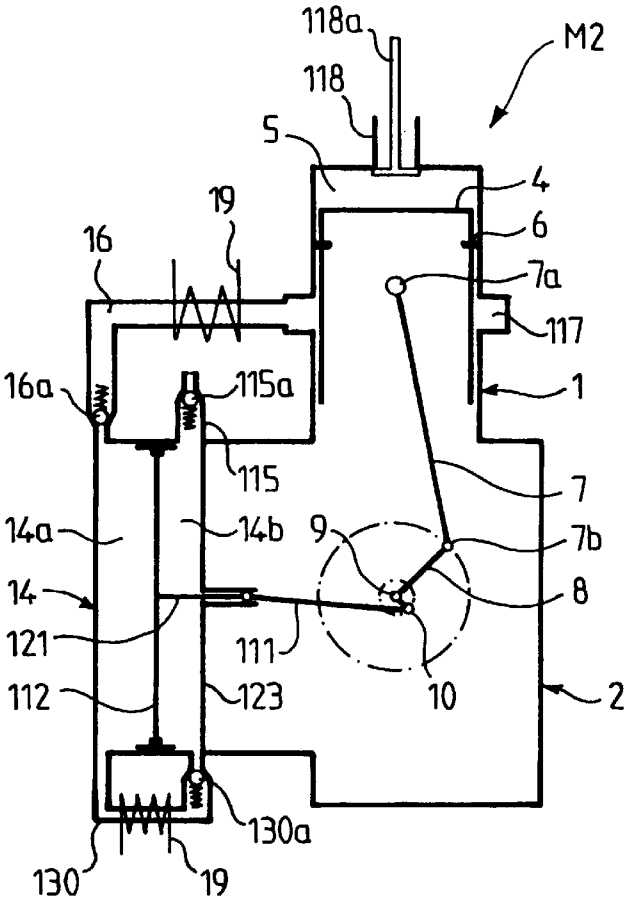
FIG. 12 is a view similar to FIG. 11 but depicting the two-stroke engine equipped with a two-stage compressor.

The three alternative forms depicted in FIGS. 10 to 12 respectively correspond to the alternative forms depicted in FIGS. 1, 4 and 8 of the loop-scavenging engine. This being the case, the operation of the uniflow engine M2 will be described just once to cover all of these three alternative forms.

In a uniflow engine as depicted in FIG. 10, the inlet pipe 16 opens to an annular ring 117 surrounding the bottom of the cylinder 1, said ring 117 having a number of ports (not depicted) which open toward the bottom of the cylinder 1 with an orientation such that the air is introduced into the cylinder with a great deal of rotational movement. The exhaust pipe 118 is at the top of the cylinder 1 and has at least one valve 118*a* which is controlled by any appropriate means.

When the engine piston 4 is at its PMH, the exhaust valve or valves 118 are closed, as are the inlet ports which are blocked by the body of the engine piston 4. At the end of the expansion phase of the engine piston 4, the exhaust valve or valves 118*a* open(s) to discharge the burnt gases, and the engine piston 4 uncovers the ports of the inlet ring 117, so that the compressed air from the compressor 14 drives the burnt gases upward toward the exhaust. The filling of the cylinder 1 with oxidizing air continues until the start of the compression phase of the engine piston 4, as long as the inlet ports remain uncovered by the engine piston 4.

Figure 13:
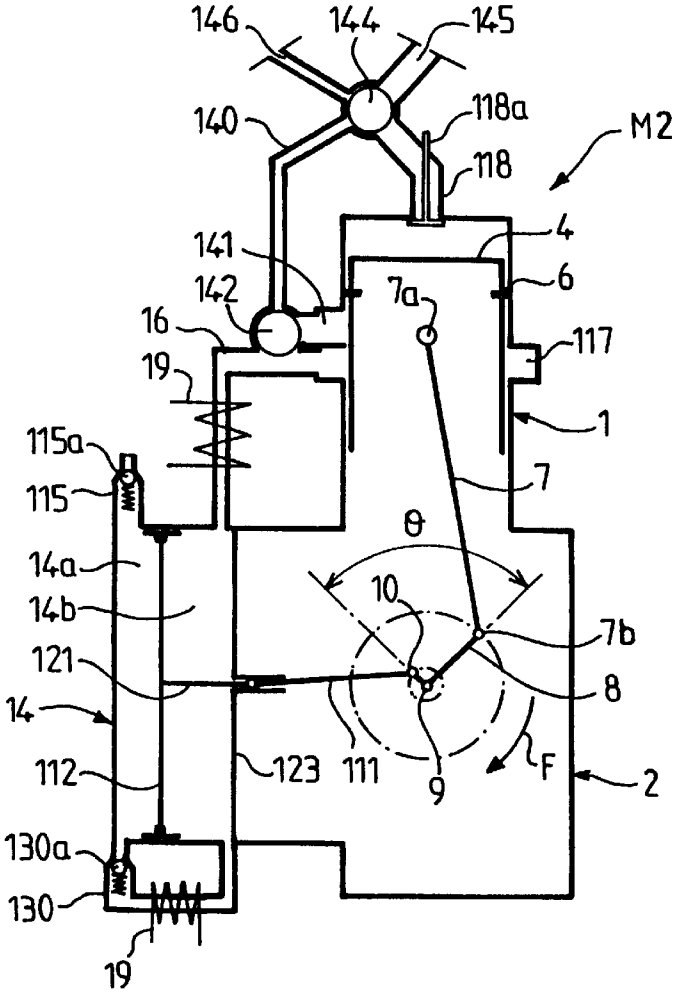
FIG. 13 is a view similar to FIG. 12 but depicting the two-stroke engine further equipped with a system for recovering the energy in the exhaust puffs.

In the alternative form of FIG. 13, the engine M2 is also fitted with a device for recovering the energy in the exhaust puffs and for partially recycling the exhaust gases. This device comprises an additional volume 140 which is formed by a pipe of appropriate cross section communicating at its two ends with a rotary shutter 142, 144 which may consist of a multi-way rotary spool. The upper spool 144 also communicates with the exhaust pipe 118, downstream of the exhaust valve or valves 118*a* provided at the top of the cylinder 1, and with two other pipes 145 and 146 which end at an exhaust manifold, not depicted.

The lower spool 142 further communicates with a pipe 141 which opens toward the bottom of the cylinder 1, above the inlet ring 117, and with the inlet pipe 16.

The rotary movements of the spools 142, 144 are connected in any appropriate ways known to the person skilled in the art and therefore not described, to the rotary movement of the crankshaft 9, in a 1/1 ratio or a ratio different than 1/1, which may be in-phase or phase-shiftable with or with respect to the movement of the crankshaft.

Furthermore, in FIG. 13, the positions of the two stages 14*a* and 14*b* of the compressor 14 are reversed with respect to the compressor piston 112. Specifically, the inlet pipe 16 communicates with the stage 14*b* located between the compressor piston 112 and the vertical wall 123, while the first stage 14*a* on the opposite side of the compressor piston 112 to the crankshaft 9 is supplied with fresh air via the intake pipe 115. Thus, the operation of the compressor 14 is reversed, and the wrist pin 8 of the crankshaft has to be phase shifted by an angle θ of about 90° with respect to the eccentric 10 in the direction of rotation F of the crankshaft 9.

When the engine piston 4 is at its PMH, any exhaust valve or valves 118*a* provided are closed as are the spools 142 and 144.

During the expansion phase of the engine piston 4, the exhaust valve or valves 118*a* open(s) and the upper shutter 144 pivots, for example in the same direction as the crankshaft 9, to cause the exhaust pipe 118 to communicate with the pipe 140 forming the additional volume. The lower spool 142 has also rotated by the same amount in the same direction, but this has not caused pipes to communicate. The result of this is that a puff of pressurized burnt gases is discharged by the exhaust pipe 118 into the pipe 140, and this compresses the air therein while at the same time introducing a portion of burnt gases into it, corresponding to the angular transfer period.

When the engine piston 4 reaches an intermediate position between the pipe 141 and the inlet ring 117, the exhaust valve or valves 118*a* are still open but the spool 114 which has rotated places the pipes 118 and 145 in communication while at the same time closing the passage to the pipe 140; the lower spool 142 has also rotated, but without causing communication. What this means is that the air/burnt gases mixture which was previously introduced under pressure (about 3.5 bar at full load) into the pipe 140 is trapped therein and the burnt gases escape through the pipe 145 to the exhaust manifold.

When the engine piston 4 reaches its PMB, the upper shutter 144, although it has continued to rotate, maintains the communication between the pipes 118 and 145; the lower shutter 142 has also rotated, but without causing communication; the ports of the inlet ring 117 are uncovered. What this means is that air from the stage 14*b* of the compressor 14 performs scavenging which removes the burnt gases through the exhaust valve or valves 118*a* and the cylinder 1 fills with air with the relatively high pressure of the compressor 14. The air/burnt gases mixture is still trapped under pressure in the pipe 140.

When the engine piston 4 begins its compression phase, it closes off the ports of the inlet ring 117 and lies flush with the level of the pipe 141; as the shutter 142 has continued to rotate, the pipes 118 and 145 can still communicate, but this has no effect because the exhaust valve or valves 118*a* have closed again; the lower spool 142 places the pipe 141 in communication with the pipe 140. As a result, the air/burnt gases mixture which was trapped under pressure in this pipe 140 escapes and, under pressure, fills the cylinder 1. This simultaneously supercharges the cylinder and partially recirculates the burnt gases, an operation known by the name of EGR (Exhaust Gas Recirculation), and has the effect of reducing the nitrogen oxides emissions at low speed.

When the engine piston 4 continues its compression, until it shuts off the pipe 141, the exhaust valve or valves 118*a* remain closed, and the spools 142, 144 pivot into a position in which all communication is prevented.

When the engine piston 4 essentially reaches the end of the compression stroke, the exhaust valve or valves 118*a* remain closed, but the upper spool 114 places the pipe 140 in communication with the pipe 146; the lower spool 142 places the pipe 140 in communication with the inlet pipe 16. As a result, the fresh air from the compressor 14 flows through the pipes 16, 140 and 146 to discharge the residual air/burnt gases mixture in the pipe 140 to the outside.

When the engine piston reaches PMH, the cycle is ready to recommence.

Figure 14:
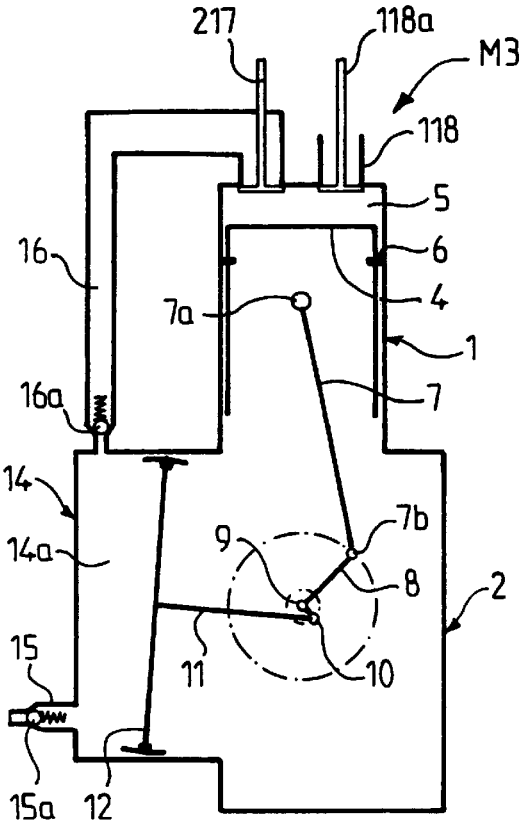
FIGS. 14 and 15 are views similar to FIGS. 1 and 4 respectively but depicting a third embodiment of the two-stroke engine of the invention, of the type with exhaust and inlet valves.
Figure 15:
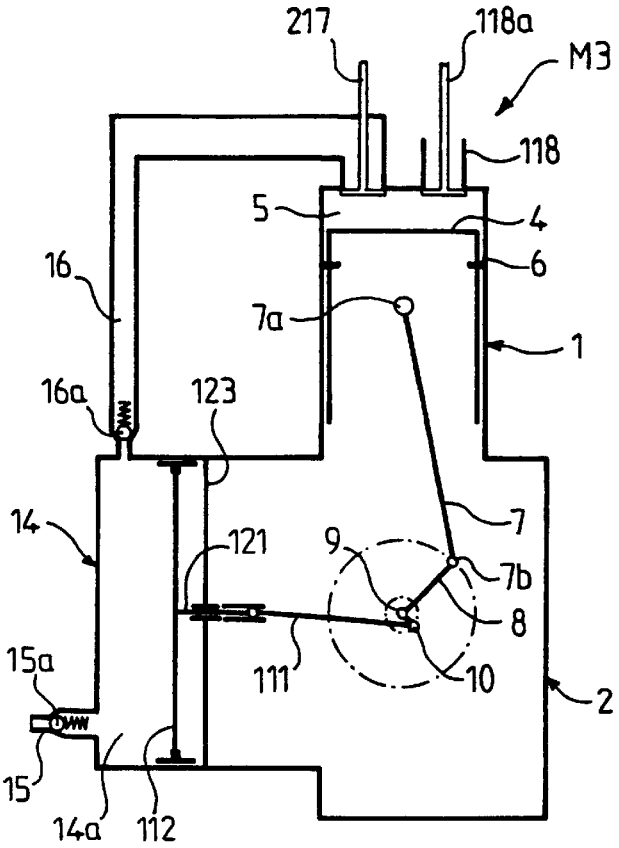

FIGS. 14 and 15 depict the application of the invention to an engine M3 of the two-stroke single-cylinder type with inlet and exhaust valves.

FIGS. 14 and 15 depict two alternative forms which correspond to the alternative forms of FIGS. 10 and 11 of the engine M2 of the uniflow type.

The only difference common to both alternative forms lies in the fact that the inlet pipe 16 opens at the top of the cylinder 1 where there are one or more inlet valves 217. The operation of this type of engine is similar to the previous types of operation.

Although the two alternative forms of FIGS. 14 and 15 contain a single-stage compressor, it would also be possible to envisage a two-stage compressor (see the engine of the type depicted in FIG. 17) and/or a device for partially recirculating the exhaust gases, without departing from the scope of the invention.

Figure 17:
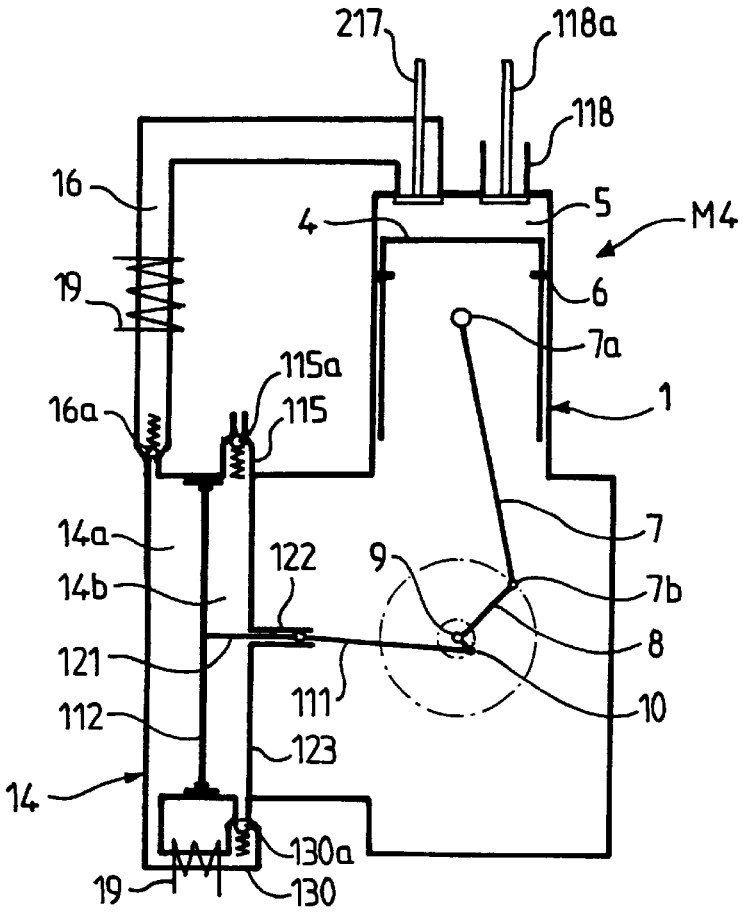
FIG. 17 is a view similar to FIG. 15 but depicting a four-stroke engine equipped with a two-stage compressor.

FIG. 17 depicts an engine M4 with a two-stage compressor which can be used just as easily for a two-stroke engine or a four-stroke engine. The components of this engine M4 which are identical to those of the engines described earlier bear the same reference numerals.

FIGS. 18 to 25 depict the various phases of the operating cycle of a four-stroke engine M4 of the type with exhaust and inlet valves and a single-stage compressor containing a rocking compressor piston. Of course, the engine M4 could have one or more cylinders. The way in which the four-stroke engine works will now be described with reference to FIGS. 18 to 25.

Figure 18:
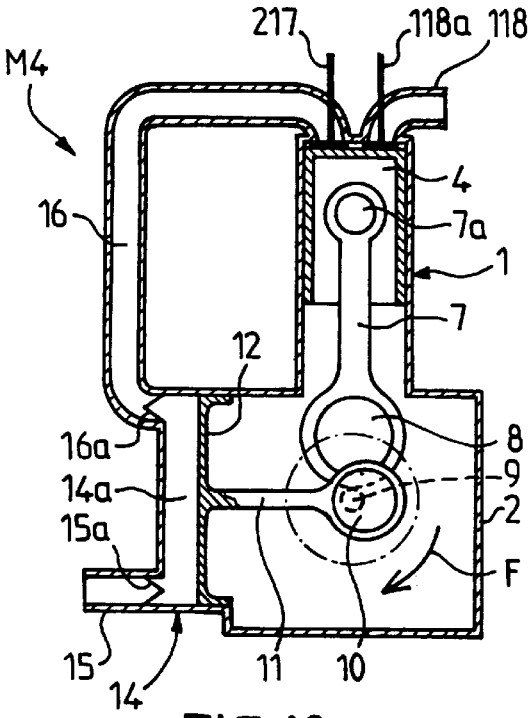
FIGS. 18 to 25 are part views in section similar to FIG. 14 depicting a four-stroke engine during the various successive phases of its cycle.

In FIG. 18, the engine piston 4 is at the end of its compression stroke, at its PMH, while the compressor piston 14 is at its PMB, that is to say in the position furthest to the right in FIG. 18. In this position, the inlet valve 217 and the exhaust valve 118*a* are closed, as is the inlet valve 15*a* and the delivery valve 16*a*. The angular phase shift between the wrist pin 8 and the eccentric 10 is of the order of 90°, but this phase shift is more precisely calculated according to the efficiency of the compressor and the cylinder filling ratio. The position illustrated in FIG. 18 corresponds to ignition of the carburated mixture in the combustion chamber.

For the position illustrated in FIG. 18, the chamber 14*a* of the compressor 14 is filled with fresh air, while the inlet pipe is filled with compressed hot air.

Figure 19:
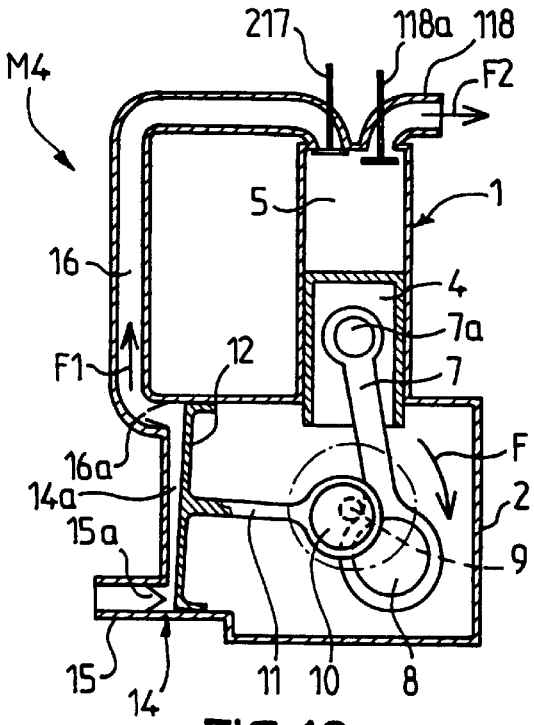

During expansion, under the action of the combustion of the gases in the combustion chamber 5, the engine piston makes a downstroke, as illustrated in FIG. 19, after the crankshaft 9 has rotated through about 150°, this simultaneously causing the compressor piston 12 to rock about its upper portion, and then start to rock about its lower portion, thus performing a first compression in the combustion chamber 14*a*.

As illustrated in FIG. 18, the crankshaft 9 rotates in the clockwise direction illustrated by the arrow F.

In the position illustrated in FIG. 19, the combustion chamber 5 is full of burnt gases which begin to be exhausted through the exhaust duct 118, as illustrated by the arrow F2, following the opening of the exhaust valve 118*a* which moves into its lower position as illustrated in FIG. 19. The inlet valve 15*a* remains closed, but the delivery valve 16*a* opens, which allows the compressed air in the compressor chamber 14*a* to be delivered to the inlet pipe 16 which already contains some compressed air. Thus, further-compressed air is obtained in the inlet pipe 16, as illustrated by the arrow F1.

Figures 20, 21, 22, 23, 24, 25:
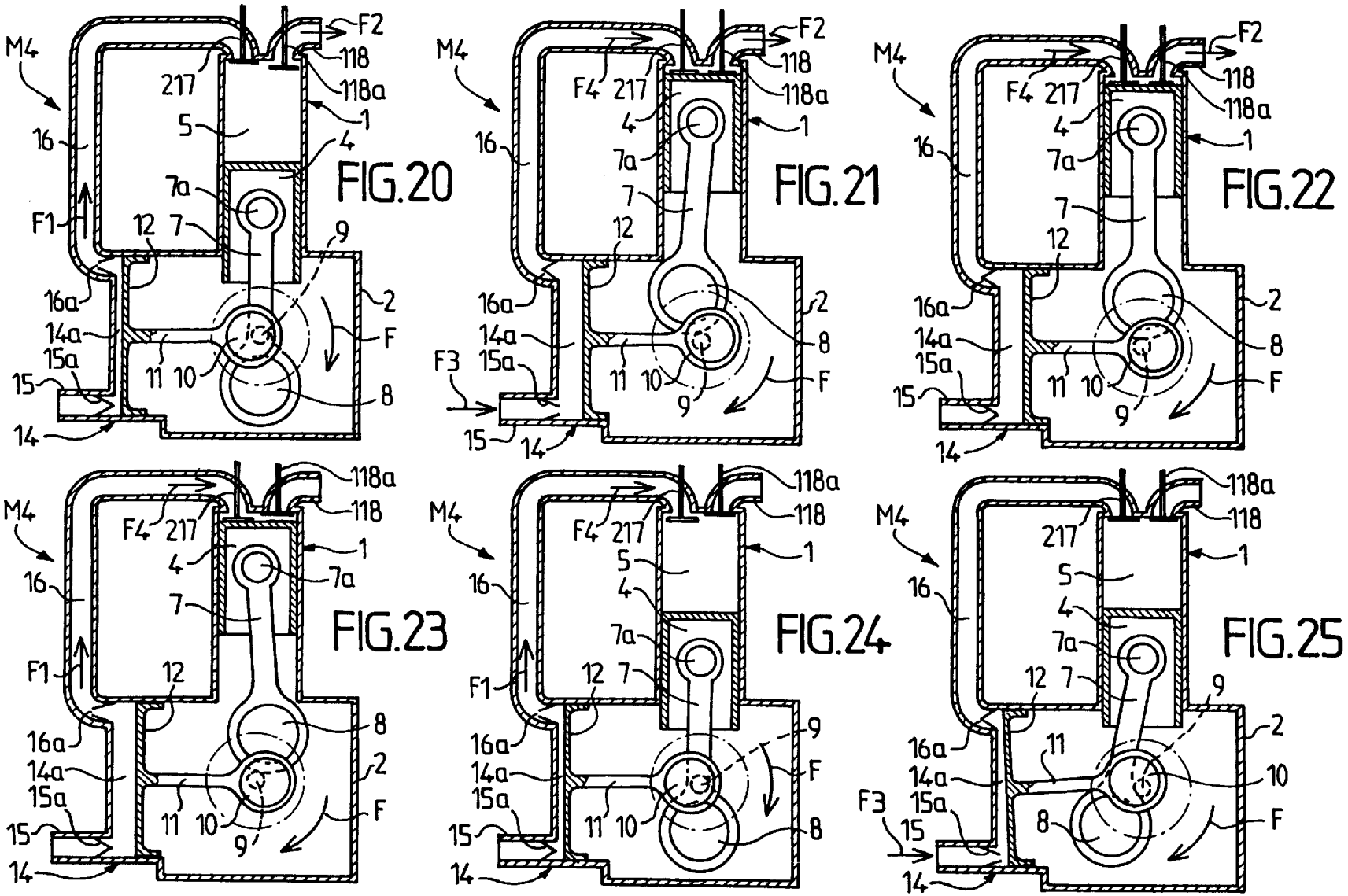

At the end of the expansion stroke, the engine piston 4 reaches its PMB, as illustrated in FIG. 20, after a rotation of about a further 30° in the clockwise direction as indicated by the arrow F. In this position, the compressor piston 12 has finished rocking about its lower portion to reach its position of maximum compression furthest to the left in the compression chamber 14*a*. The inlet valve 15*a* remains closed and the delivery valve 16*a* remains open to finish the further compressing of the air in the inlet pipe 16, as indicated by the arrow F1. In this position, the burnt gases continue to escape through the exhaust duct 118, in the direction of the arrow F2. The first stroke of the four-stroke cycle of the engine M4 has here been accomplished.

During later rotation of the crankshaft 9, as illustrated in FIG. 21, the engine piston 4 during the phase of compressing the combustion chamber, delivers the burnt gases to the exhaust duct 118. In the position illustrated in FIG. 21, the crankshaft is rotated through about a further 160°. In this position, the compressor piston 12 has rocked about its upper portion, then about its lower portion, to reach a position of expansion of the compression chamber 14*a*. During the expansion phase of the compressor 14, the inlet valve 15*a* is open and the delivery valve 16*a* is closed, so that fresh air is drawn into the compression chamber 14*a* as indicated by the arrow F3. At the same time, the inlet valve 217 opens to allow compressed air into the combustion chamber as illustrated by the arrow F4 and thus to drive the rest of the burnt gases toward the exhaust duct. FIG. 22 shows the end of the compression stroke of the engine piston 4, for which stroke the crankshaft 9 has covered a rotation of 360° with respect to its initial position illustrated in FIG. 18. In this position, the inlet valve 15*a* has closed and the two valves 217 and 118*a* remain open. The arrow F4 indicates the admission of compressed hot air into the combustion chamber. The position of FIG. 22 illustrates the second stroke of the four-stroke cycle.

To proceed to FIG. 23, the crankshaft 9 has pivoted through a further twenty or so degrees to begin the expansion phase of the engine piston 4. In this position, the exhaust valve 118*a* has closed again but the inlet valve remains open. The delivery valve 16*a* also opens to deliver the fresh air contained in the compression chamber 14*a* into the inlet pipe 16 as indicated by the arrow F1. When the engine piston 4 reaches its PMB as illustrated in FIG. 24, that is to say during the third stroke of the four-stroke cycle, the combustion chamber 5 has been filled with hot compressed air from, on the one hand, the compressed air contained in the inlet pipe 16 and, on the other hand, the compressed air contained in the compression chamber 14*a* and delivered by the compressor piston 12, given that the delivery valve 16*a* has remained open. Double filling of the combustion chamber 5 has thus been achieved.

FIG. 25 depicts the additional rotation of the crankshaft 9 through about 30°. In this position, the two valves 217 and 118*a* are closed and the start of compression of the air contained in the combustion chamber 5 is achieved. The delivery valve 16*a* is also closed, but the inlet valve 15*a* is open to once again allow fresh air into the compression chamber 14*a*. At the end of the compression stroke of the engine piston 4, at the latest, the fuel can be injected into the combustion chamber 5. Then, the engine piston 4 reaches its PMH, as illustrated in FIG. 18.

Although this is not depicted, the various engines of the invention may be fitted with injectors for the direct or indirect injection of petrol or diesel, or may alternatively operate using precarburated mixtures.

Figure 16:
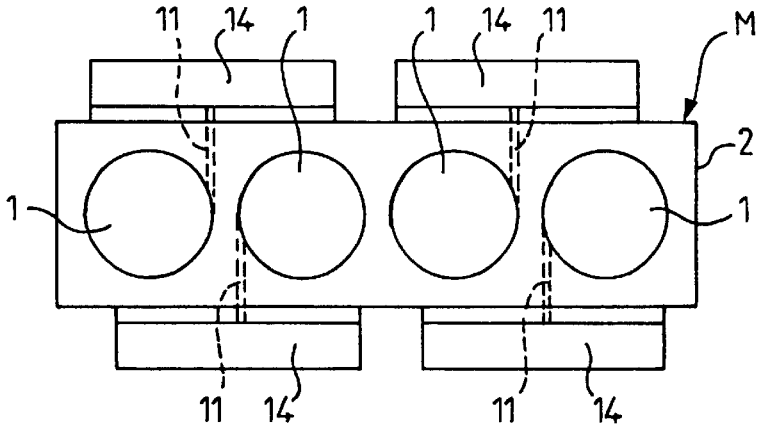
FIG. 16 is a diagrammatic view from above of an in-line four-cylinder engine according to the invention.

Finally, FIG. 16 depicts an engine M with four in-line cylinders 1 having four compressors 14 of the single-stage type with rocking compressor piston, the link rods 11 of which are depicted off-centered from the axis of the respective cylinder, the compressors 14 being arranged on each lateral face of the crankcase 2, alternately.

Of course, the invention is just as applicable to all types of single- or multi-cylinder engines, in an in-line or V configuration.

Although the invention has been described in conjunction with a number of particular embodiments, it is quite obvious that it is not in any way restricted thereto and that it encompasses all technical equivalents of the means described and combinations thereof if these fall within the context of the invention.

What is claimed is:

1. Two-stroke or four-stroke internal combustion engine (M, M1, M2, M3, M4), operating by admitting a carbureted mixture or by admitting fresh air with the direct or indirect injection of fuel, the engine having at least one cylinder (1) defining a variable-volume combustion chamber (5) in which an engine piston (4) coupled by a connecting rod (7) to the wrist pin (8) of a crankshaft (9) executes a reciprocating movement, and a compressor (14) associated with each cylinder in order to supercharge the cylinder with carbureted mixture or with fresh air, characterized in that said compressor (14) is a compressor with at least one stage, in the compression chamber (14*a*, 14*b*) of which there moves a compressor piston (12, 112, 212) which is coupled to the crankshaft (9) by a link rod (11, 111) articulated to an eccentric (10), said compressor piston being a deformable diaphragm (212) connected at its periphery to the side wall of the compression chamber, said diaphragm preferably having an undulation (212*a*) at its periphery, to make it easier to deform, said compressor piston (112, 212) being secured at its center to a rod (121) articulated to the link rod (111) for connection to said eccentric (10), said rod being guided in translation in a direction which intersects the axis of the cylinder (1), said eccentric being mounted on the shaft of said crankshaft (9), and in that the angle (θ) of the dihedron, the solid angle of intersection of which is formed by the axis of the crankshaft (9) and the two half-planes of which extend one toward the eccentric (10) and the other toward the wrist pin (8), is of the order of 90° so as to obtain a phase shift between the top dead center (PMH) positions of the engine piston (4) and of the compressor piston (12, 112, 212) which are associated with the same cylinder, which phase shift ensures that the pressure in the compression chamber (14*a*, 14*b*) is at its maximum before the carbureted mixture or the fresh air is admitted into the combustion chamber (5).

2. Engine according to claim 1, characterized in that when the stage (14*b*) of the compression chamber which communicates directly with the cylinder (1) is located between the compressor piston (112, 212) and the crankshaft (9), the wrist pin (8) has a phase shift in advance of the eccentric (10) in the direction of rotation (F) of the crankshaft and, conversely, when the aforementioned stage (14*a*) is on the opposite side of the compressor piston (12, 112, 212) to the crankshaft, the eccentric has a phase shift in advance of the wrist pin in the direction of rotation of the crankshaft.

3. Engine according to claim 1, characterized in that the cylinder capacity of the compressor (14) is of the order of magnitude of that of the cylinder (1), but with a compressor piston (12, 112, 212) which has a diameter markedly greater than the diameter of the engine piston (4), so that the compressor piston has a short compression stroke (C) in the compression chamber.

4. Engine according to claim 1, characterized in that the compressor piston is a rigid cylinder (112) which can move in axial translation and is fitted at its periphery with at least one sealing ring.

5. Engine according to claim 1, characterized in that the compressor piston (12) is rigidly attached at its center to the link rod (11) for connection with the eccentric (10) so that the compressor piston moves in the compression chamber (14*a*) by rocking back and forth about lower and upper parts of the compression chamber, the axis of the compressor (14) being offset, in the direction of the axis of the crankshaft (9), with respect to the axis of the cylinder (1).

6. Engine according to claim 5, characterized in that the compressor piston (12) has, at its periphery, a spherical edging (12*a*) fitted with a spherical sealing ring (13) which is preferably unable to rotate with respect to the compressor piston, in a position such that the gap in the ring is not placed at the bottom of the compressor (14).

7. Engine according to claim 1, characterized in that the compression chamber has two stages (14*a*, 14*b*) located one on each side of the compressor piston (112, 212), a first stage (14*a* or 14*b*) being supplied with carburated mixture or with fresh air by a first nonreturn valve (115*a*) or a valve, and connected by a delivery duct (130) fitted with a second nonreturn valve (130*a*) or a valve to the second stage (14*b* or 14*a*) which communicates with the cylinder (1) via an inlet duct (16) possibly fitted with a third nonreturn valve (16*a*) or a valve.

8. Two-stroke internal combustion engine according to claim 1, characterized in that it is equipped with an additional volume (40, 140) communicating with the cylinder (1) through closure and opening means (42, 44; 142, 144), the movements of which are controlled either in synchronism or with a phase shift with respect to those of the engine piston (4) in the cylinder so that during the expansion phase, the burnt gases compress the air in the additional volume and at least partially enter it, so that this air and burnt gases mixture is trapped under pressure therein, and then so that this mixture is admitted into the cylinder during the compression phase.

9. Engine according to claim 8, characterized in that after the air and burnt gases mixture previously trapped in the additional volume (40, 140) has been admitted into the cylinder (1), said additional volume is once again filled with fresh air from the compressor (14).

10. Engine according to claim 8, characterized in that the aforementioned closure and opening means comprise two rotary shutters (42, 44; 142, 144), for example multi-way rotary spools, connected to each other by the additional volume (40, 140), one (42, 142) of the shutters being associated with the compressor (14), and the other shutter (44, 144) being associated with the exhaust from the cylinder (1).

11. Engine according to claim 10, characterized in that the two rotary shutters are arranged in such a way that the following operations take place: in a first phase, when the engine piston (4) is near its PMH, a flow of air from the compressor (14) passes through the lower shutter (42, 142) associated with the compressor, sweeps through the additional volume (40, 140), passes through the upper shutter (44, 144) associated with the exhaust and is exhausted to the outside via an exhaust manifold; in a second phase, from about halfway through the expansion stroke of the engine piston, on the one hand, the upper shutter (44, 144) places the cylinder (1) in communication with the additional volume so as to fill it with a pressurized mixture of air and burnt gases and, on the other hand, the cylinder communicates with the exhaust; in a third phase, the upper shutter traps the air and burnt gases mixture in the additional volume; in a fourth phase, air from the compressor (14) is admitted into the cylinder and, in a fifth phase, at the start of the engine piston compression stroke, the trapped and pressurized mixture is admitted into the cylinder.

12. Engine according to claim 11, characterized in that the upper shutter (44) is connected to the cylinder (1) by a pipe (45) arranged toward the bottom of the cylinder and the lower shutter (42) is fitted on the delivery pipe (130) between the two stages (14*a*, 14*b*) of the compressor (14) so that the additional volume (40) is pressurized by means of the burnt gases from the cylinder (1) through the upper shutter (44) and is emptied into the cylinder through the pipe (45) connected to the upper shutter.

13. Engine according to claim 11, characterized in that the upper shutter (144) is associated with at least one exhaust valve (118*a*) located at the top of the cylinder (1) and the lower shutter (142) is connected to the cylinder (1) by a pipe (141) arranged toward the bottom of the cylinder so that the additional volume (140) is pressurized via its upper end by the burnt gases from the exhaust valve (118*a*) through the upper shutter (144) and is emptied into the cylinder via its lower end through the lower shutter (142).

14. Engine according to claim 13, characterized in that it is of the uniflow type (M2), in which the carburated mixture or the air is admitted toward the bottom of the cylinder (1) through inlet ports distributed at the base of the cylinder and supplied by a ring (117), itself connected to the compressor (14), while the burnt gases from the previous cycle are discharged through one or more exhaust valves (118*a*) located at the top of the cylinder.

15. Two-stroke internal combustion engine according to claim 13, characterized in that it is of the type with exhaust and inlet valves (M3, M4), in which the valves (118*a*, 217) are located at the top of the cylinder (1) and the inlet valve or valves (217) are supplied by the compressor (14).

16. Engine according to claim 1, characterized in that it is of loop scavenging type (M1), in which the carburated mixture or the fresh air is admitted from the compressor (14) through an inlet duct (16) opening via ports (17) into the lower part of the cylinder (1) with an orientation such that the mixture or the air is introduced with a looping upward rotating movement, while the burnt gases from the previous cycle are discharged through exhaust ports (8) also arranged toward the bottom of the cylinder.

17. Engine according to claim 1, characterized in that it is of the type with several in-line cylinders (M), in which the compressors (14) associated with each cylinder (1) are arranged alternately on each face of the crankcase (2).

18. Four-stroke internal combustion engine according to claim 1, wherein it is of the type with exhaust and inlet valves, in which the valves are located at the top of the cylinder and the inlet valve or valves are supplied by the compressor.

* * * * *